US005400572A

United States Patent [19]

Peck et al.

[11] Patent Number: 5,400,572

[45] Date of Patent: Mar. 28, 1995

[54] POOP SCOOPING AND PACKAGING ASSEMBLY

[76] Inventors: Joel S. Peck, 1960 Kapiolani Blvd., Suite 113-504, Honolulu, Hi. 96826; Jeffrey Kapec, 248 Wilton Rd., Westport, Conn. 06880; Allan B. Chcochinov, 81 Irving Pl., New York, N.Y. 10003; Kazuna Tanaka, 5 Frontier Rd., Cos Cob, Conn. 06807

[21] Appl. No.: 980,241

[22] Filed: Nov. 23, 1992

[51] Int. Cl.[6] ..... B65B 67/00

[52] U.S. Cl. ..... 53/459; 53/390; 53/393; 294/1.3; 294/1.4

[58] Field of Search ..... 15/257.2, 257.4; 294/1.3, 1.4, 1.5; 53/284.7, 390, 393, 459, 469, 570.

[56] References Cited

U.S. PATENT DOCUMENTS

| | | | |
|---|---|---|---|
| 3,382,523 | 5/1968 | Parsisson | 15/257.2 |
| 4,010,970 | 3/1977 | Campbell | 294/1.5 |
| 4,012,067 | 3/1977 | Travis | 294/1.4 |
| 4,165,895 | 8/1979 | Bacoka | 294/1.4 |
| 4,185,861 | 1/1980 | Berner | 294/1.5 |
| 4,191,414 | 3/1980 | Dameron | 294/1.4 |
| 4,243,259 | 1/1981 | Wright | 294/1.3 |
| 4,335,678 | 6/1982 | Garza et al. | 294/1.5 |
| 4,705,310 | 11/1987 | Scripter | 294/1.4 |
| 4,875,729 | 10/1989 | Peck | 294/1.3 |
| 4,896,912 | 1/1990 | Parnell | 294/1.3 |

FOREIGN PATENT DOCUMENTS

| | | | |
|---|---|---|---|
| 3325696 | 1/1985 | Germany | 294/1.4 |
| 2198347 | 6/1988 | United Kingdom | 294/1.4 |

*Primary Examiner*—John Sipos
*Assistant Examiner*—Daniel Moon
*Attorney, Agent, or Firm*—Michael Ebert

[57] ABSTRACT

A scooping and packaging assembly adapted to scoop up and package poop deposited on a surface by a pet animal on a surface so that one may then dispose of the poop. The assembly consists of a loop provided with a handle, a hand-held wand and a rectangular plastic-film bag whose dimensions are such that when the loop and wand are inserted into the bag through its open end, they are separated from each other to an extent permitting manipulation of the wand relative to the loop. In operating the assembly, the user, who in one hand grasps the handle of the loop, and in the other grasps the wand while holding onto the open end of the bag, advances the closed end of the bag along the surface toward the poop and manipulates the wand to push the poop onto the outside of the bag in the region within the confines of the loop, the poop depressing the region to form a pocket depending from the loop. Then, after removing the wand from the bag, the user inverts the bag over the pocket so that now the poop is inside the bag and is packaged thereby in condition for disposal.

9 Claims, 3 Drawing Sheets

POOP SCOOPING AND PACKAGING ASSEMBLY

BACKGROUND OF INVENTION

1. Field of Invention

This invention relates generally to devices adapted to scoop up and dispose of waste material or poop deposited on a surface by a pet dog or other animal, and more particularly to a poop scooping and packaging assembly which acts to scoop up the poop and place it within a plastic-film bag for disposal.

2. Status of prior Art

A pet dog is said to be housebroken when trained to excretory habits acceptable for indoor living, for the dog is taught to confine these habits to the outdoors. In a rural environment, this presents no problem, for the dog is free to deposit solid waste material or poop in an open field. But in urban and suburban communities, where the deposit of poop on sidewalks or in other public places cannot be tolerated, pet owners are now faced with so-called "pooper scooper" laws. These mandate that those responsible for a dog or other pet animal must promptly remove poop deposited by the pet on a sidewalk or other outdoor site.

Since a violation of these laws may be subject to heavy fines, pet owners seek in various ways to comply therewith without, however, becoming soiled in the process of doing so. The most obvious way of scooping up poop from the sidewalk is to use a conventional dust pan and brush for this purpose, the user, as he advances the dust pan toward the poop, pushing it with the brush into the dust pan as he would dirt. Then the poop must be transferred from the dust pan into a paper or plastic-film bag for disposal. The practical objection to this procedure and the reason it is rarely used is that dust pan and the brush are contaminated by the poop and must therefore be cleaned and sterilized after being put to use.

Another approach is to train the pet dog to deposit poop on a sheet of newspaper placed on the ground by the dog owner who, after a deposit is made, folds the paper into a package for disposal. But this leaves much to be desired; for it is difficult to train a dog to defer depositing poop until the owner has found a convenient place to lay down a sheet of newspaper. Moreover, it is not a pleasant experience for the dog owner to have to fold a newspaper sheet about a poop deposit.

A more commonly used technique is for the dog owner to place one of his hands in a small, plastic-film bag, using the bag as a glove to pick up the poop. The dog owner then pulls the bag off his hand by inverting it, thereby packaging the poop inside the bag so that the poop is bagged and can then be discarded. Apart from the fact that the dog owner is required to handle the poop with his gloved hand—an experience that many find distasteful—is the possibility that the bag may not be properly sealed or that it will rupture in use and thereby soil the handler.

Dog poop is excrement; and while dog owners are generally law-abiding and have no wish to defy "scooper pooper" laws, these laws are nevertheless disobeyed by many dog owners. The reason for this is that the handling of disease-bearing poop is not only a repellent activity, but one in which there is a risk of contamination.

The poop handling technique of greatest prior art interest and one which makes it possible to isolate the handler from the poop and thereby encourage compliance with the "scooper pooper" laws is the technique disclosed in the 1989 patent to Peck, U.S. Pat. No. 4,875,729. This technique makes use of a triangular frame having a handle attached to its apex, the frame being inserted into a small plastic-film bag so that the broad base of a frame is adjacent the closed end of the bag covering the frame.

In use, the bag-covered peck frame is held at an angle to the ground surface on which the poop is deposited, and then advanced to scoop up the poop so that it falls within the confines of the bag-covered frame. The user, with his other hand, then inverts the bag so that the outside of the bag becomes the inside and the poop is then contained therein to provide a disposable package.

The advantage of a peck technique is that the user's hands are isolated from the poop and there is no risk of contamination. The practical drawback of the peck technique is that it is not always effective in scooping up poop. The mass, firmness and configuration of poop depends on the dog and what the dog excretes on a given occasion. It is not always easy, therefore, simply with a forward motion of the bag-covered frame, to scoop up the poop, for there is no force holding the poop in place or pushing it toward the advancing bag-covered frame. In contradistinction, with a conventional dust pan and brush arrangement, the brush functions as a tool that cooperates with the pan to push waste matter into the pan. In the absence of the brush, a forward motion of the pan may only succeed in pushing the waste matter forward.

SUMMARY OF INVENTION

In view of the foregoing, the main object of this invention is to provide a poop scooping and package assembly consisting of a loop having a handle, a wand, and a plastic film rectangular bag whose dimensions are such as to receive the loop and wand so that they are separated from each other.

A significant feature of the invention is that it makes it possible with one hand to advance the bag-covered loop toward the poop to be picked up while manipulating the bag-covered wand with the other hand to push the poop toward the advancing loop. Thus, the invention makes use of a procedure similar to that used with a dust pan and brush, but without its disadvantages.

Also an object of the invention is to provide a loop handle whose long edges are formed by parallel cylinders each having a front end bore to socket the ends of a pear-shaped wire hoop to create a closed loop, the cylinders being bridged by an arched web to define a channel to receive the wand so that it extends into the loop, whereby the assembly in its storage mode is highly compact.

Another advantage of the invention is that its channel-shaped loop handle functions as a holder for storing a supply of plastic-film bags, so that all components of the assembly in its storage mode are available to the user.

Briefly stated, these objects are attained in a scooping and packaging assembly adapted to scoop up and package poop deposited on a surface by a pet animal so that one may then dispose of the poop. The assembly consists of a loop provided with a handle, a hand-held wand and a rectangular plastic-film bag whose dimensions are such that when the loop and wand are inserted into the bag through its open end, they are separated from each other to an extent permitting manipulation of the wand relative to the loop.

In operating the assembly, the user, who in one hand grasps the handle of the loop, and in the other grasps the wand while holding onto the open end of the bag, advances the closed end of the bag along the surface toward the poop and manipulates the wand to push the poop onto the outside of the bag in the region within the confines of the loop, the poop depressing the region to form a pocket depending from the loop. Then, after removing the wand from the bag, the user inverts the bag over the pocket so that now the poop is inside the bag and is packaged thereby in condition for disposal.

BRIEF DESCRIPTION OF DRAWINGS

For a better understanding of the invention as well as other objects and further features thereof, reference is made to the following detailed description to be read in conjunction with the accompanying drawings, wherein.

DESCRIPTION OF INVENTION

Figure 1:
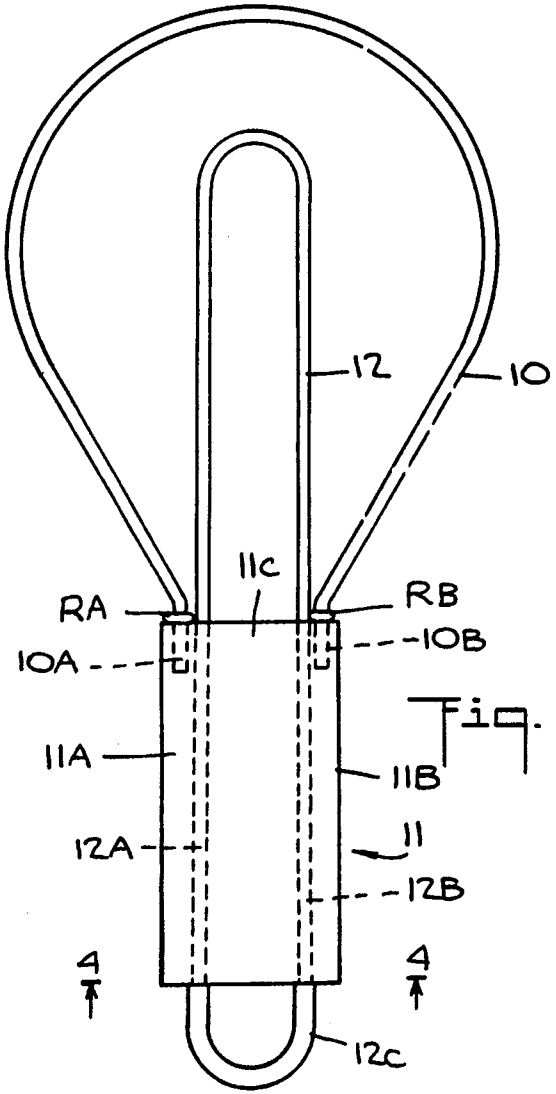
FIG. 1 is a plan view of the loop and its handle, and the wand included in an assembly in accordance with the invention, as these components are arranged in the storage mode of the assembly.
Figures 5, 10, 11:
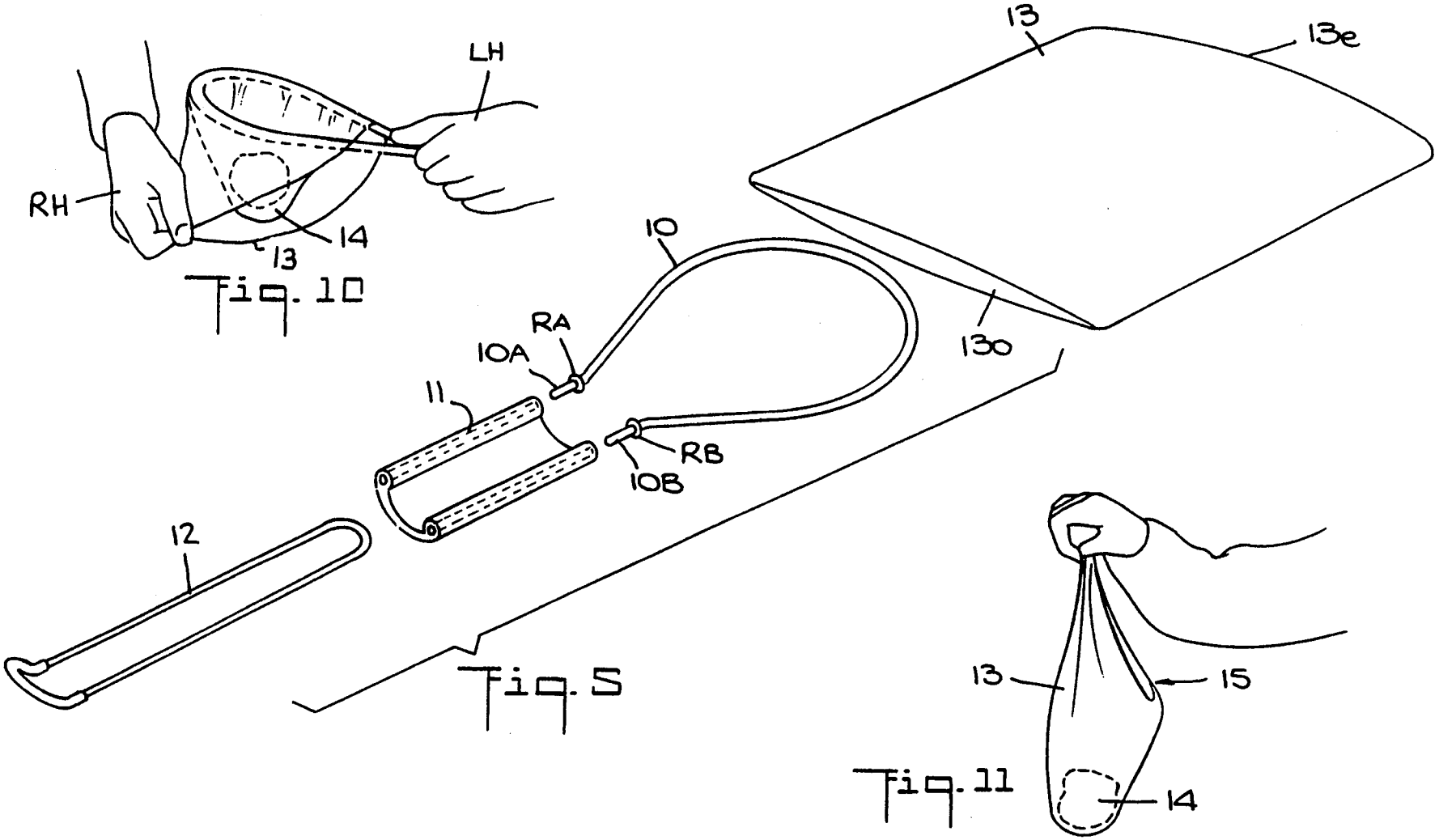
FIG. 5 is an exploded view of the assembly.
FIG. 10 shows the final step in which the bag is inverted over the pocket to package the poop inside the bag.
FIG. 11 shows the poop when it is contained in the bag and packaged thereby.

Referring now to FIGS. 1 and 5, there is shown a poop scooping and packaging assembly in accordance with the invention. The assembly consists of the following components: a loop 10 provided with a handle 11, a hand-held wand 12, and a rectangular, plastic-film bag 13 having an open end 13*o* and a closed end 13*e*.

FIG. 1 shows the assembly in its storage mode with wand 12 slid into handle 11 and extending into loop 10 to form a compact structure. This makes it easy for a user to carry the assembly when taking a dog or other pet outside. Loop 10 is formed of a length of resilient wire, preferably stainless steel, which is bent into a pear-shaped hoop having ends 10A and 10B.

Handle 11, which is preferably extruded or molded of synthetic plastic material of high strength, such as polyethylene or polypropylene, is formed by a pair of parallel cylinders 11A and 11B defining the straight edges of the handle, the front end of the cylinders having bores $B_1$ and $B_2$ therein. The cylinders are bridged by a web 11C having an arched cross section, as best seen in FIG. 4.

Figure 3:
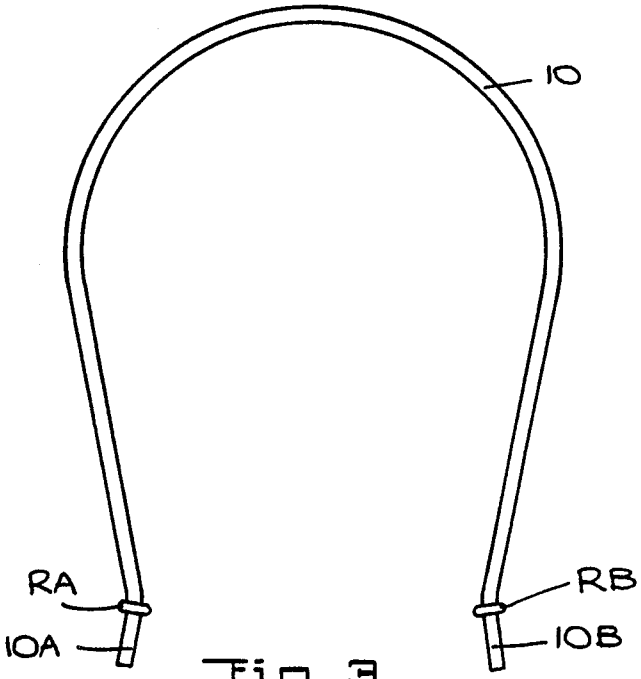
FIG. 3 shows the wire hoop from which the loop is formed, the hoop being shown in its unstressed state before being attached to the handle.

The resilient wire hoop forming loop 10, in its unstressed state as shown in FIG. 3, has its ends 10A and 10B spaced apart by a distance greater than the distance between the bores $B_1$ and $B_2$ at the front end of handle cylinders 11A and 11B. To attach the hoop to the handle and in doing so to create a closed loop, the hoop is compressed to bring its ends 10A and 10B in line with bores $B_1$ and $B_2$, the ends being then inserted therein. Because the resilient wire hoop seeks to return to its unstressed state, ends 10A and 10B socketed in the bores of the cylinders exert a holding force on the cylinders which acts to firmly secure the loop to the handle. Ends 10A and 10B have O-rings RA and RB fitted thereon which abut the upper ends of cylinders 10A and 10B.

Figure 2:
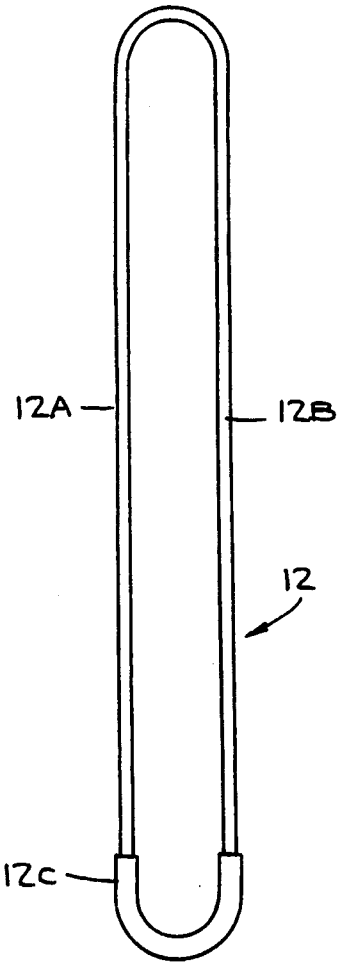
FIG. 2 is a plan view of the wand.

Wand 12, as best seen in FIGS. 2 and 5, is made from a length of stainless wire or similar material that is bent and welded to form an elongated closed loop having parallel branches 12A and 12B, and a U-shaped rear end 12C, which is angled down with respect to the branches. The rear end is coated with nylon or other synthetic, plastic material, so that this end of the wand functions as a handle therefor.

Figure 4:
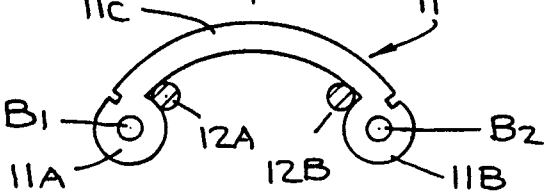
FIG. 4 is a front end view of the handle in which the hoop is socketed.

Loop handle 11 is trough or channel-shaped and is adapted to slidably receive wand 12, whose branches 12A and 12B, as best seen in FIG. 4, are received at the respective junctions of cylinders 11A and 11B and web 11C of the handle. In the storage mode of the assembly, as shown in FIG. 1, wand 12 is slid into channel-shaped handle 11, the wand extending into loop 10 and its bent-down rear end 12C projecting from the rear end of the handle.

In one actual working embodiment of the assembly, the combined length of loop 12 and its handle 11 is $10\frac{1}{2}$ inches, the loop having a maximum width of $5\frac{1}{2}$ inches. The length of wand 12 is 10 inches; but because its bend-down rear end 12C does not slide into the handle, the wand inserted in the handle extends into the loop so that its front end is spaced about $1\frac{1}{2}$ inches from the peak of the loop.

The dimensions of the bag must be such that when the loop and the wand are inserted therein through its open end, the loop and wand are then separated from each other to an extent permitting manipulation of the wand relative to the loop. Suitable for this purpose are commercially available food storage bags, such as those sold under the BAGGIES trademark of Mobil Chemical Company-Consumer products Division, whose dimensions are $11\frac{1}{2} \times 12\frac{1}{2}$ inches.

Figure 6:
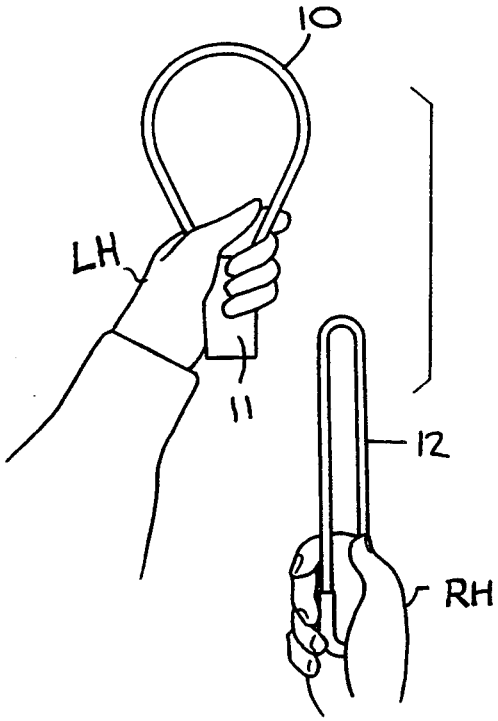
FIG. 6 shows the first step in putting the assembly to use, in which the wand is detached from the loop.
Figure 7:
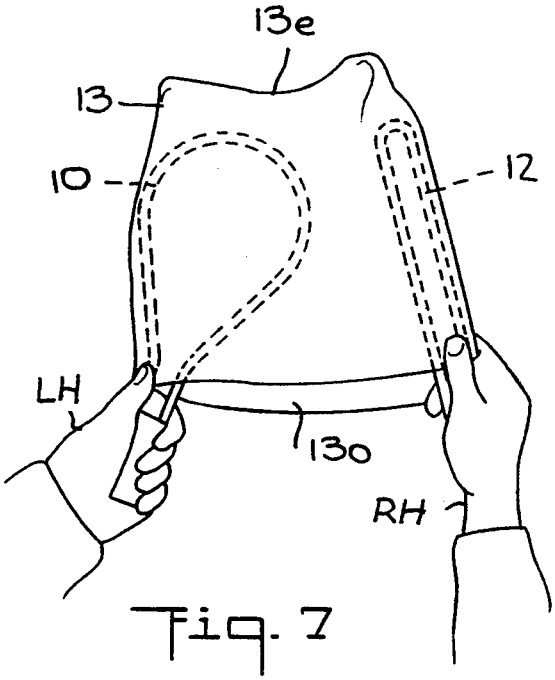
FIG. 7 shows the second step in which the loop and wand are inserted into a plastic bag through its open end, so that now the assembly is in its operating mode.

To put the assembly to use in its operating mode, one must first detach wand 12 from loop 10 and its handle 11, as shown in FIG. 6. Then grasping loop 10 by its handle with the left hand LH and grasping wand 12 by the right hand RH, these implements, are shown in FIG. 7, are inserted into bag 13 through its open end. The implements are so placed in the bag so that loop 10 is on one side of the bag with its peak adjacent the closed end, while the wand is on the opposite side of the bag with its front end adjacent the closed end.

To maintain the implement on opposite sides of the bag, the user with the thumb and fingers of each hand holds onto the front end of the bag. Because of the space between these implements in the bag, the user is able to manipulate the wand relative to the loop within the constraints imposed by the bag in a manner similar to that by which one manipulates a brush relative to a dust pan in order to scoop up waste matter.

Figure 8:
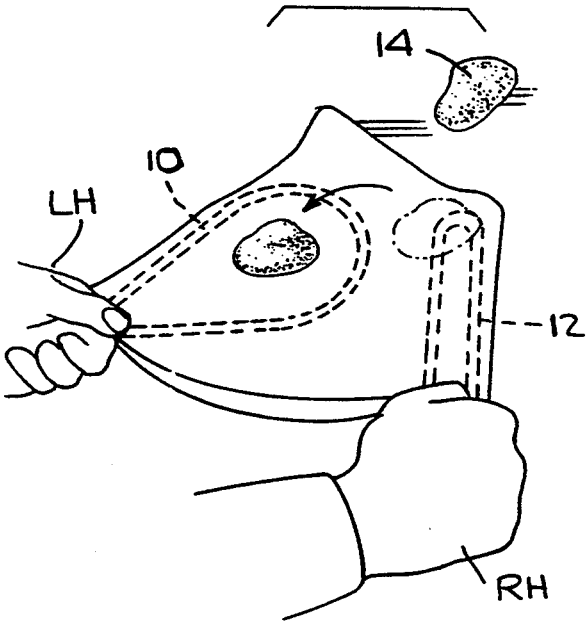
FIG. 8 shows how the assembly is operated to scoop up a poop deposit.
Figure 9:
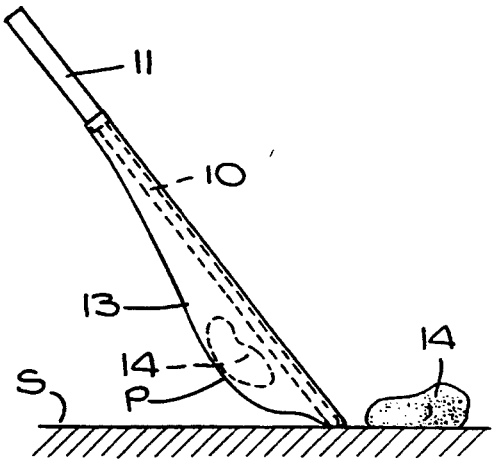
FIG. 9 illustrates in a side view how the poop placed within the region of the bag confined by the loop creates a pocket.

As shown in FIGS. 8 and 9, the user holding the bag-covered loop in one hand and the wand in the other with the closed front end of the bag extending forwardly, then advances the front end of the bag toward poop 14 on surface S on which it is deposited.

In order to scoop up this poop, the user, manipulating the bag-covered wand 12 as if it were a brush, engages the poop and pushes it onto the outer surface of the bag to occupy the region lying within the confines of loop 10. When so placed, the poop depresses this region to form a pocket p suspended from the loop. In this state, the poop rests on the outside surface of the bag.

As shown in FIG. 10, the user, after having withdrawn wand 12 from the bag and set it aside so that now the left hand LH holds handle 11 of loop 10 and his right hand RH is free, then uses his right hand to invert bag 13 over pocket P so that now poop 14 is inside the bag and the loop is outside the bag and can be set aside.

Finally, as shown in FIG. 11, poop 14 contained within bag 13 forms a package 15, whose open end can be knotted or tied and then disposed of as the user sees fit.

The nature of the assembly and its operation are such that at no time does the user's hand come into contact with the poop, either directly or indirectly through the bag. Hence, even if the bag were defective in some way, the user's hands would not be soiled and contaminated by the poop.

In practice, the channel-shaped handle can be used to accommodate and store several bags which are folded so that they can be nested in the handle. In this way, when the user purchases the assembly in its storage mode, he has all of the assembly components necessary to carry out a poop scooping and packaging operation.

The assembly may be made in a disposable version with the loop and its handle as well as the wand all made of low-cost, synthetic plastic material, with a supply, say, of a dozen bags included in the assembly. In this way, the user, after having used up the bags, can then dispose of the entire assembly, and then acquire a fresh disposable assembly. The assembly is usable not only for poop deposited by a dog, but also that excreted by other animals, such as cats and horses.

In a preferred embodiment of a disposable assembly that incorporates a supply of several plastic bags, the handle takes the form of an elongated box containing a supply of plastic bags and having an outlet in its upper side through which one may withdraw the bags one at a time. In this assembly, the loop is secured to the front end of the box-handle and extends forwardly therefrom. The wand takes the form of an elongated tongue-depressor stick attached to a box-like cup that telescopes over the rear end of the box-handle, the stick then extending along the underside of the box-handle. To put the assembly to use, the operator has only to withdraw the wand from the box-handle and remove a bag therefrom, and then place the loop and the wand within the bag and proceed in the manner previously described.

While there has been shown and described a preferred embodiment of a poop scooping and packaging assembly in accordance with the invention, it will be appreciated that many changes and modifications may be made therein without, however, departing from the essential spirit thereof. Thus, the wand need not be in the wire form shown, but may take the form of a plastic or wood stick so formed as to be slidable within the handle of the loop.

We claim:

1. A poop scooping and packaging assembly adapted to scoop up and package poop deposited by an animal on a surface, said assembly comprising:

(a) a loop provided with a handle;

(b) a hand-held wand; and (c) a rectangular bag formed of synthetic plastic-film material having an open end through which the loop and the wand are inserted, and a closed end, said bag having dimensions permitting the loop and wand inserted in the bag to occupy positions adjacent opposite sides of the bag, the loop and the wand being then separated from each of other within the bag to an extent permitting manipulation of the wand relative to the loop whereby the poop may be scooped onto an outside surface of the bag in a region thereof confined by the loop the poop causing the region to depress to form a pocket depending from the loop, the user then inverting the bag over this pocket to place the poop inside the bag and thereby create a package for disposing of the poop.

2. An assembly as set forth in claim 1, wherein said loop is formed by a hoop of resilient wire having spaced ends, and said handle has long edges defined by a pair of parallel cylinders, each cylinder having at its front end a bore to receive a respective end of the hoop, thereby creating the loop.

3. An assembly as set forth in claim 2, wherein said hoop is made of a length of stainless steel wire which is bent into a hoop shape.

4. An assembly as set forth in claim 3, wherein said hoop is defined by a semi-circular end joining converging sides.

5. An assembly as set forth in claim 2 wherein said wand is formed by an endless loop of wire having parallel branches.

6. An assembly as set forth in claim 5, wherein said wand has a rear end section that is angled with respect to the branches to form a handle for the wand.

7. An assembly as set forth in claim 5, wherein said handle is provided with an arched web that bridges said cylinders to create a channel-shaped handle, said wand being slidable in said channel to form a compact assembly.

8. An assembly as set forth in claim 7, wherein said channel-shaped handle is dimensioned to store a supply of said bags.

9. A technique making use of a loop having a handle, a wand and a rectangular plastic-film bag having an open end and a closed end to scoop up and package poop deposited by an animal on a surface comprising the steps of:

(a) manually inserting the loop and the wand through the open end into the bag so that they occupy positions adjacent the sides of the bag and are spaced from each other by a distance sufficient to permit manipulation of the wand relative to the loop, the loop handle being held in one hand of the user and the wand in the other hand;

(b) holding the open end of the bag with the fingers of the same hands which hold the handle of the loop and the wand so as to retain the loop and wand within the bag while advancing the closed end of the bag along the surface toward the poop;

(c) manipulating the bag-covered wand so as to place the poop over an outside surface of the bag to occupy a region within the confines of the bag-covered loop and to depress this region to form a pocket depending from the loop; and (d) inverting the bag over the pocket to place the poop inside the bag and thereby create a disposable package.

* * * * *